US006924257B2

(12) United States Patent
Klos et al.

(10) Patent No.: US 6,924,257 B2
(45) Date of Patent: Aug. 2, 2005

(54) DEVICE AND METHOD FOR GENERATING A LIQUID DETERGENT CONCENTRATE FROM A SOLID DETERGENT AND A METHOD FOR WASHING A VEHICLE

(75) Inventors: Terry James Klos, Victoria, MN (US); Scott A. Johansen, Minneapolis, MN (US); Paul J. Mattia, Prior Lake, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

(21) Appl. No.: 10/705,797

(22) Filed: Nov. 10, 2003

(65) Prior Publication Data

US 2004/0101455 A1 May 27, 2004

Related U.S. Application Data

(63) Continuation of application No. 09/829,429, filed on Apr. 9, 2001, now Pat. No. 6,645,924.

(51) Int. Cl.[7] ..... C11D 17/00

(52) U.S. Cl. ..... 510/189; 510/220; 510/224; 137/268; 222/64; 222/67; 222/251; 134/93

(58) Field of Search ..... 510/224, 220, 510/189; 137/268; 222/67, 64, 251; 134/93

(56) References Cited

U.S. PATENT DOCUMENTS 3,816,351 A * 6/1974 Lancz ..... 510/241
4,020,865 A * 5/1977 Moffat et al. ..... 137/268
4,569,781 A 2/1986 Fernholz et al.
4,595,520 A 6/1986 Heile et al.
4,680,134 A 7/1987 Heile et al.
4,687,121 A 8/1987 Copeland
4,690,305 A 9/1987 Copeland
4,718,447 A * 1/1988 Marshall ..... 137/268
4,725,376 A 2/1988 Copeland
RE32,763 E 10/1988 Fernholz et al.
RE32,818 E 1/1989 Fernholz et al.
4,826,661 A 5/1989 Copeland et al.
4,846,989 A 7/1989 Killa
4,964,184 A 10/1990 Lewis
5,137,694 A 8/1992 Copeland et al.
5,194,230 A 3/1993 PeKarna et al.
5,389,344 A 2/1995 Copeland et al.
5,397,506 A 3/1995 Groth et al.
5,439,020 A * 8/1995 Lockhart ..... 137/3
5,505,915 A 4/1996 Copeland et al.
5,782,109 A 7/1998 Spriggs et al.
5,873,268 A 2/1999 Spriggs et al.
5,975,352 A 11/1999 Spriggs et al.
6,017,864 A 1/2000 Brittain et al.
6,143,257 A 11/2000 Spriggs et al.

* cited by examiner

*Primary Examiner*—Charles Boyer
(74) *Attorney, Agent, or Firm*—Merchant & Gould P.C.

(57) ABSTRACT

A device for generating a liquid detergent concentrate from a solid detergent is provided. The device includes a solid detergent reservoir for holding solid detergent, a stock solution reservoir for holding stock solution, and a hot water heater for controlling the temperature of water used to generate the stock solution from the solid detergent. A method for generating a liquid detergent concentrate from a solid detergent and a method for washing a vehicle are provided.

10 Claims, 6 Drawing Sheets

DEVICE AND METHOD FOR GENERATING A LIQUID DETERGENT CONCENTRATE FROM A SOLID DETERGENT AND A METHOD FOR WASHING A VEHICLE

This application is a continuation of U.S. application Ser. No. 09/829,429 that was filed with the United States Patent and Trademark Office on Apr. 9, 2001 and that issued as U.S. Pat. No. 6,645,924 on Nov. 11, 2003. The entire disclosure of U.S. application Ser. No. 09/829,429 is incorporated herein by reference.

FIELD OF THE INVENTION

The invention relates to a device for generating a liquid detergent concentrate from a solid detergent, a method for generating a liquid detergent concentrate from a solid detergent, and to a method for washing a vehicle.

BACKGROUND OF THE INVENTION

Liquid detergent concentrates for use in the vehicle washing industry are conventionally shipped in large containers. Typically, a line is attached to the container containing the large amount of liquid detergent concentrate, and a portion of the liquid detergent concentrate is drawn off for each vehicle washing cycle. Shipping large concentrates of liquid detergent can be expensive. In addition, disposal of the container that holds the liquid detergent concentrate can be problematic.

As an alternative to shipping large volumes of liquid concentrate, large volumes of liquid concentrate can be generated on site by mixing a detergent powder with water. Once the liquid concentrate is used up, a new batch of liquid concentrate can be prepared. One technique for preparing a liquid concentrate from detergent powder is by submerging the detergent powder in a tank filled with an aqueous solution. This technique requires an operator to place detergent directly into standing water. Splashing caused by adding the detergent directly into the concentrated solution and/or mechanical mixing using a mixing blade can pose a safety hazard.

Much attention has been directed by Ecolab Inc., the assignee of this patent application, in preparing liquid detergents from solid detergent concentrates. This focus of attention has been directed mostly at warewashing and clothes washing. See, for example, U.S. Pat. No. 4,687,121 issued to Copeland et al; and U.S. Pat. Nos. 4,569,781 and 4,569,780 issued to Fernholz et al.

SUMMARY OF THE INVENTION

A device for generating a liquid detergent concentrate from a solid detergent is provided according to the invention. The device includes a solid detergent reservoir, a water inlet, a stock solution reservoir, and a hot water heater. The solid detergent reservoir is provided for holding solid detergent, and includes a stock solution generating region for generating stock solution from solid detergent provided within the solid detergent reservoir. The water inlet is provided for directing water onto solid detergent provided within the solid detergent solution generating region of the solid detergent reservoir for generating stock solution. The stock solution reservoir is provided for holding stock solution generated in the stock solution generating region. The stock solution reservoir includes a stock solution inlet for receiving stock solution from the stock solution generating region, a stock solution outlet for removal of stock solution from the stock solution reservoir, and a stock solution level sensor for sensing the level of stock solution provided within the stock solution reservoir and for generating a first signal and a second signal. The first signal indicates when the stock solution reservoir requires additional stock solution, and the second signal indicates when the stock solution reservoir has a sufficient amount of stock solution. The hot water heater is provided for controlling the temperature of water provided to the water inlet.

A method for generating a liquid detergent concentrate from a solid detergent is provided according to the invention. The method includes steps of: (a) applying water against a solid detergent in a solid detergent reservoir to provide a liquid detergent concentrate, wherein the water is provided at a relatively constant temperature and the relatively constant temperature is provided within a range of about 40° F. and about 150° F.; (b) collecting the liquid detergent concentrate in a liquid detergent concentrate reservoir; (c) monitoring the amount of liquid detergent concentrate within the liquid detergent concentrate reservoir and providing a first signal and a second signal, the first signal indicating when sufficient liquid detergent concentrate is provided within the liquid detergent concentrate reservoir and the second signal indicating when more liquid detergent concentrate is needed within the liquid detergent concentrate reservoir; and (d) controlling the flow of water against the solid detergent provided within the solid detergent reservoir based on the first signal and the second signal.

A method for washing a vehicle is provided according to the invention. The method includes steps of: (a) applying water against a solid detergent provided within a solid detergent reservoir to generate a liquid detergent concentrate; (b) collecting the liquid detergent concentrate in a liquid detergent concentrate reservoir; (c) withdrawing liquid detergent concentrate from the liquid detergent concentrate reservoir and combining the liquid detergent concentrate with water to provide a use solution; and (d) washing the vehicle with the use solution.

DETAILED DESCRIPTION

Figure 1:
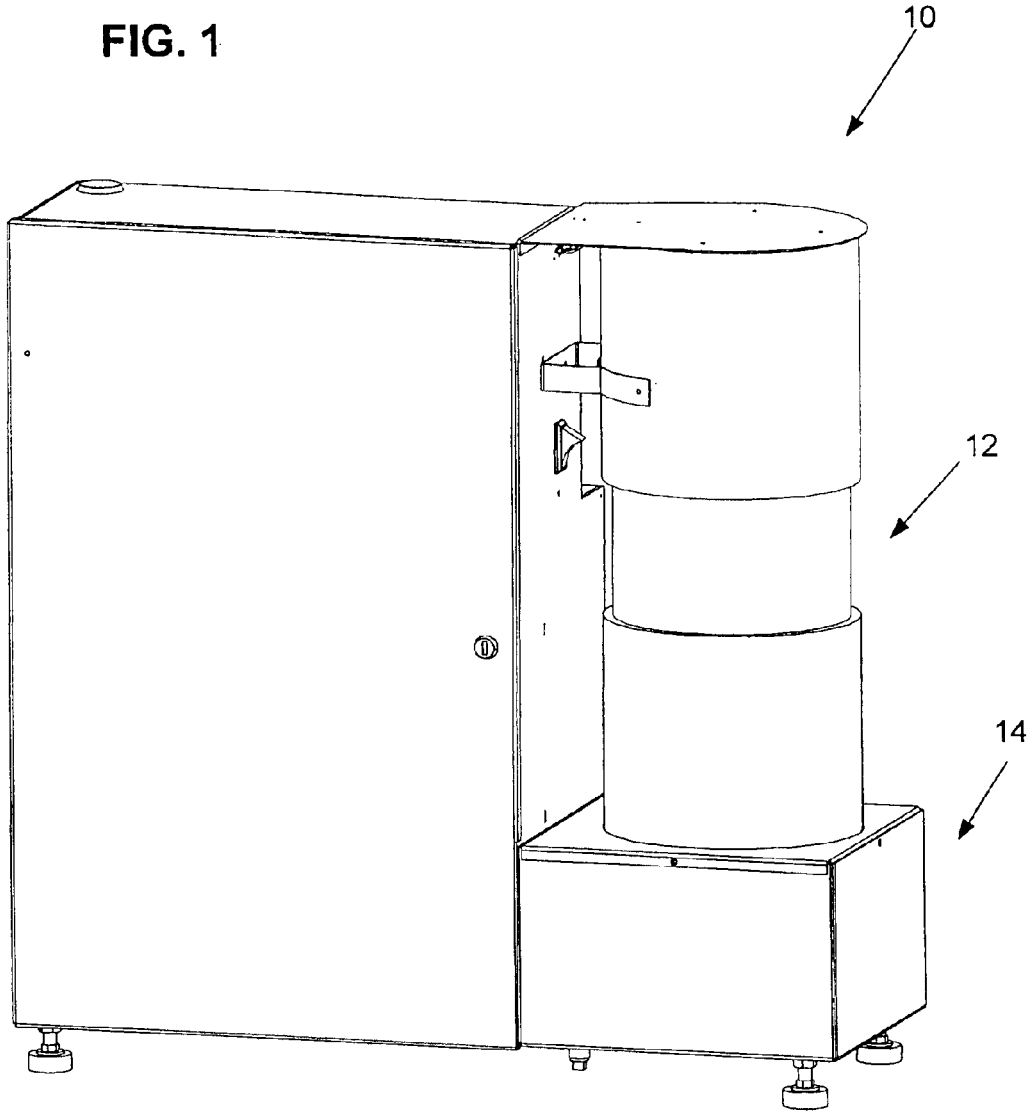
FIG. 1 is a perspective view of a device for generating a liquid detergent concentrate from a solid detergent according to the principles of the invention.
Figure 2:
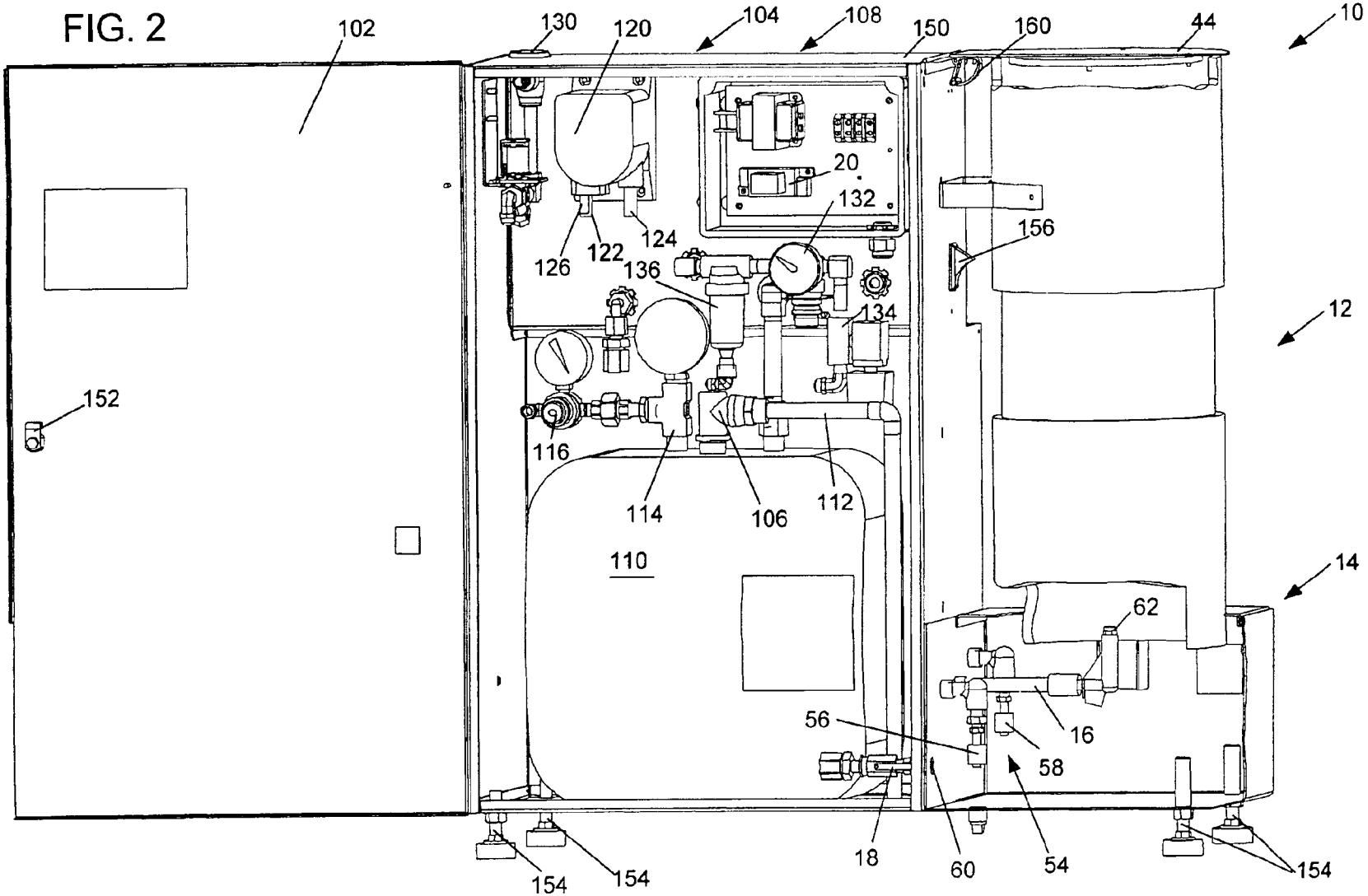
FIG. 2 is a front view of the device for generating a liquid detergent concentrate from a solid detergent of FIG. 1 with the door open showing the internals of the device.
Figure 3:
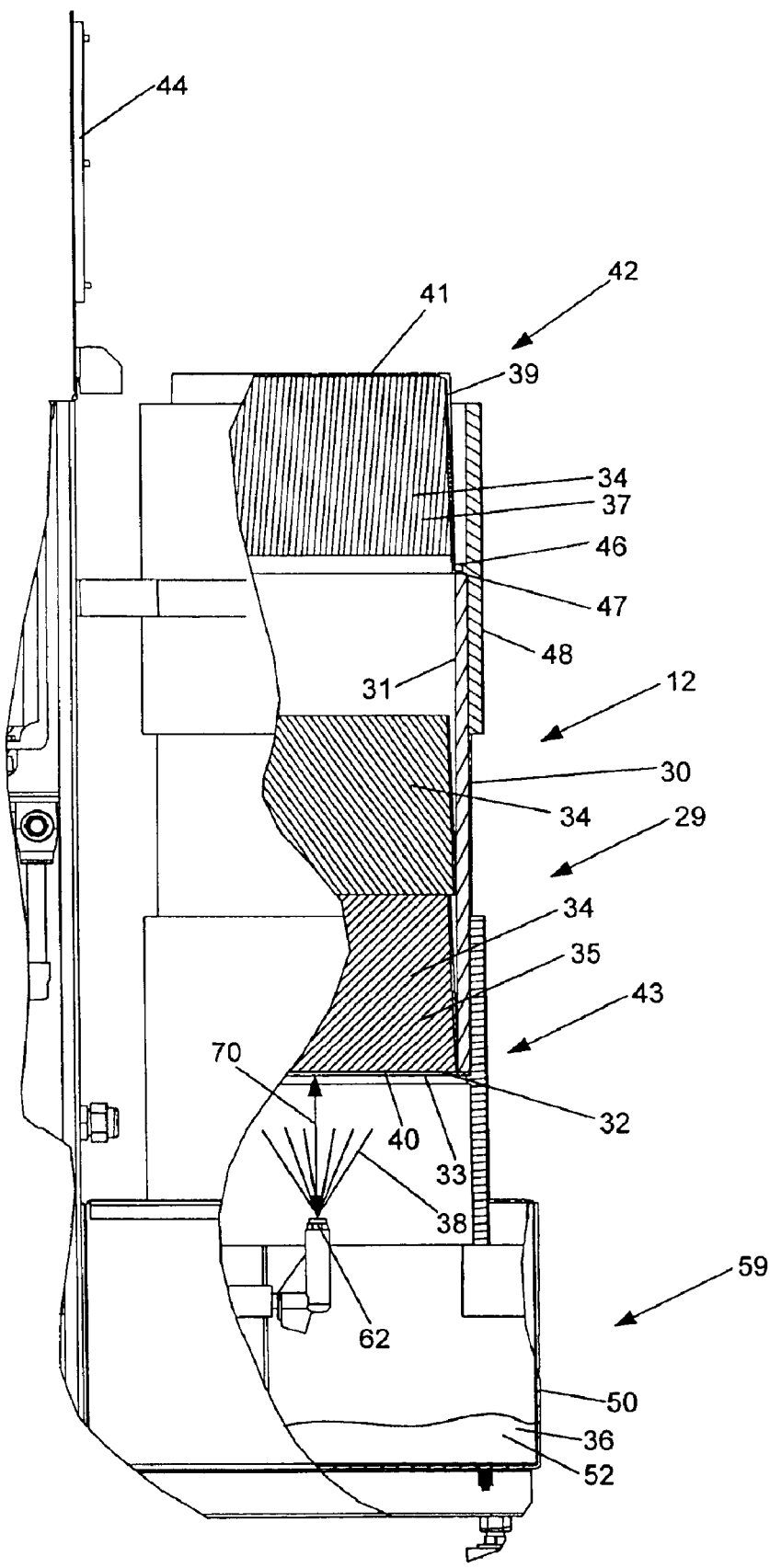
FIG. 3 is a partial cut-away view of the device for generating a liquid detergent concentrate from a solid detergent of FIG. 1.

Now referring to FIGS. 1–3, a device for generating a liquid detergent concentrate from a solid detergent according to the invention is shown at reference numeral 10. The device for generating a liquid detergent concentrate from a solid detergent 10 can be referred to more simply herein as the "device." The device 10 includes a concentrated detergent reservoir 12, a stock solution reservoir 14, a water inlet line 16, a stock solution outlet line 18, and a processing unit 20. The processing unit 20 controls the operation of the device 10. The processing unit 20 receives information about the conditions within the stock solution reservoir 14 and instructs other components of the aqueous detergent generating device 10 to generate or stop generating stock solution depending upon the conditions within the stock solution reservoir 14.

The concentrated detergent reservoir 12 includes a detergent guide 30 having an inner surface 31 that holds the solid detergent in place within the concentrated detergent reservoir 12. The concentrated detergent reservoir 12 additionally includes a support member 32 for holding the detergent within the concentrated detergent reservoir 12. The support member 32 is preferably provided in the form of a screen 33 that allows water and aqueous detergent to flow therethrough. Accordingly, the detergent provided within the concentrated detergent reservoir 12 is contained by the detergent guide 30 and the support member 32.

The concentrated detergent provided within the detergent guide 30 is preferably a solid 29 provided in the form of solid blocks 34. A plurality of solid blocks 34 can be arranged within the concentrated detergent reservoir 12. The screen 33 is provided to support the blocks 34 and to allow concentrated aqueous detergent 36 to flow out of the concentrated detergent reservoir 12 and into the stock solution reservoir 14. Preferably, a water stream 38 is directed against the exposed surface 40 of the block 34. It should be appreciated that the term "exposed surface" refers to the portion of the concentrated detergent against which a water stream is directed and becomes degraded as the water stream removes the detergent. The exposed surface 40 shown in FIG. 3 is the bottom surface of the lowest block 35 that is degraded as the water stream 38 is directed against it. As the aqueous detergent 36 is generated, the height of the stack of blocks 34 deteriorates and new blocks 37 can be added at the opening 42. Preferably, a cover 44 is provided for covering the opening 42. Preferably, the concentrated detergent reservoir 12 is sufficiently enclosed to contain the detergent concentrate generated therein. It should be understood that the source that provides the water could be any source of water including recycled water, municipal water, well water, pond water, etc. The portion of the concentrated detergent reservoir 12 where the stock solution 52 is generated can be referred to as the stock solution generating region 43.

New solid blocks 37 can be added to the concentrated detergent reservoir 12 through the opening 42. The new solid blocks 37 are preferably provided in a container 39. The container 39 is preferably a bucket 41. The combination of the new solid block 37 and bucket 41 can be inverted as shown in FIG. 3 and introduced into the concentrated detergent reservoir 12. The lip 46 of the bucket 41 is preferably constructed so that it rests on the top edge 47 of the detergent guide 30. The detergent reservoir 12 includes an outer wall 48 that contains the detergent guide 30 and the bucket 41 within the concentrated detergent reservoir 12. As the bucket lip 46 rests on the edge 47, the solid block 37 can fall out of the bucket 41 and is guided by the detergent guide 30 so that it sits on top of a lower solid block 34. The bucket 41 can then be removed from the concentrated detergent reservoir 12 and discarded. An advantage of this technique for introducing solid blocks into the concentrated detergent reservoir 12 is that operator contact of the solid blocks 34 can be avoided.

The stock solution reservoir 14 includes a container 50 for holding the stock solution 52, and a sensor 54 for sensing the amount of stock solution 52 provided within the container 50. When additional stock solution 52 is desired, the sensor 54 provides a signal indicating that additional stock solution 52 needs to be prepared. When the container 50 contains a sufficient amount of stock solution 52, the sensor 54 provides a signal indicating that no additional stock solution 52 needs to be prepared. The sensor 54 includes a low level sensor 56 and a high level sensor 58. The low lever sensor 56 is triggered when the level of the stock solution 52 decreases to a level that reflects a need for additional stock solution to be prepared. The high level sensor 58 is triggered when the level of the stock solution 52 is at a sufficiently high level that additional stock solution need not be prepared.

The stock solution reservoir 14 includes a stock solution inlet 59 that allows stock solution 52 to enter into the container 50, and a stock solution outlet 60 that is provided for drawing stock solution 52 out of the container 50. The stock solution 52 can be pumped or aspirated out of the container 50 and then combined with a high-pressure water line for delivery as a detergent use solution for washing a substrate or surface such as the surface of a motor vehicle.

The water inlet line 16 is shown extending through the stock solution reservoir 14 and is provided with a nozzle 62 for directing water against the exposed surface 40 of the block 35. It should be appreciated that the water inlet line 16 need not extend through the stock solution reservoir 14. That is, the water inlet line 16 can be provided outside of the stock solution reservoir 14 but it is appropriate to have the water provided by the water inlet line directed against the solid detergent within the concentrated detergent reservoir 12 to generate the stock solution 52.

It is an advantage of the invention that the concentration of the stock solution 52 can be maintained at a relatively constant level for a given solid detergent composition. That is, by controlling certain parameters, such as, the distance 70 between the nozzle 62 and the exposed surface 40, the area of the exposed surface 40, the temperature of the water stream 38, the pressure of the water stream 38 against the exposed surface 40, the duration of application of the water stream 38 against the exposed surface 40, the volume of the container 50, and the opening sizes provided by the support member 32. By controlling these parameters to specific values, it is believed that the concentration of the stock solution 52 will remain relatively constant for a particular solid detergent composition. It should be appreciated that the concentration of the stock solution 52 can vary as the chemistry of the solid detergent and/or the water stream 38 vary. For example, the solid detergent can be provided so that degrades more or less easily in the presence of water, and the water chemistry may vary from one location to another location, or may include additives that affect the rate of degradation of the solid detergent.

The container 50 is preferably sized to reduce fluctuations in the concentration of the stock solution 52 and to provide a sufficient amount of stock solution for a given wash application. In general, if the volume of the container is too small, it is expected that the concentration of the stock solution may vary to an extent that it is not desirable. Although a larger container volume may be desirable to moderate fluctuations in concentration, it should be understood that a larger volume of the container may require an increased heating capacity of the water heater 110. This is particularly a concern during start up when charging the container 50 for the first time. Preferably, the volume of the container 50 is greater than about one liter, and less than about 20 liters. More preferably, the volume of the container is between about four liters and about 12 liters, and even more preferably between about six liters and about ten liters. It should be understood that the volume of the container 50 refers to the amount of the stock solution 52 that can be contained therein during operation of the device 10.

It is desirable to provide a relatively constant distance between the nozzle 62 and the exposed surface 40 of the stack of blocks 34. That is, as stock solution 52 is prepared by degradation of the solid detergent, the stack of blocks continue to move downward so that the exposed surface 40 remains the same distance away from the nozzle 62. Preferably, the spray pattern of the water 38 is provided so that the exposed surface 40 of the lowest block 35 degrades relatively uniformly across the surface area. It should be understood that the reference to degradation reflects the solubilization of the detergent. The distance between the nozzle 62 and the exposed surface 40 is preferably a function of the nozzle spray angle and is preferably provided so that the entire exposed surface is wetted. Preferably, the distance between the nozzle 62 and the exposed surface 40 is between about two inches and about 12 inches, and more preferably between about three inches and about six inches.

Stock solution 52 leaves the stock solution reservoir 14 via the stock solution outlet 60 and passes through the stock solution outlet line 18. The stock solution 52 can then be used as a detergent use solution or the stock solution 52 can be further diluted with a water stream for generating a detergent use solution. It is expected that in most vehicle washing facilities, the stock solution 52 will be injected into a water stream that is then sprayed against the surface of a motor vehicle to clean the surface of the motor vehicle. It should be appreciated that stock solution 52 and/or the resulting detergent use solution can be used to clean the surface of any article requiring cleaning.

Now referring to FIG. 2, the door 102 of the device for generating a liquid detergent concentrate from a solid detergent 10 is opened revealing the internal components 104. It should be appreciated that the flexible tubing connecting the various internal components 104 have been removed in this figure in order to more clearly illustrate the invention. During operation of the device 10, the tubing is provided.

Water enters the device 10 at water inlet 106. The port for water inlet 106 is on the backside 108 of the device 10 and is not shown in FIG. 2. Water enters the inlet 106 and flows to the hot water heater 110 where it is heated to a desired temperature. Relief line 112 is provided as a relief line to protect the hot water heater. A relief valve is provided within the relief line 112 and opens when the temperature and/or pressure conditions within the hot water heater 110 exceed desired limits. Preferably, the relief valve opens when the water temperature within the hot water heater 110 exceeds 200° F. and/or when the pressure within the hot water heater exceeds 100 lbs.

Heated water flows out of the hot water heater 110 via hot water outlet 114 and flows into the water inlet line 16. The flow of hot water out of the hot water heater 110 is controlled by the water regulator 116.

Stock solution 52 flows out of the container 50 via the stock solution outlet 60 and the stock solution outlet line 18. The device 10 includes a stock solution pump 120 that pumps the stock solution into a water stream or pumps the stock solution 52 into a venturi where it is then aspirated into a water stream. It should be understood that the device 10 might omit the stock solution pump 120 when the stock solution 52 is aspirated. In the situation where the stock solution is aspirated into a water line, it may be desirable to provide a metering device such as a valve (e.g. a needle valve), an orifice, or restrictive tubing, to adjust the flow rate of stock solution into the water stream. The stock solution pump 120 includes a stock solution inlet 122 and a stock solution outlet 124. In addition, the stock solution pump 120 includes an air inlet 126 for powering the stock solution pump 120. It should be understood that the stock solution pump 120 could be powered by electrical energy if it is more convenient to use electrical energy rather than a compressed air source as a power source.

An atmospheric vacuum breaker 130 is provided for backflow prevention to avoid siphoning of stock solution 52 into the city water supply.

The controller 20 is provided for receiving signals from the sensor 54 and, based upon those signals, regulating the flow of heated water out of the hot water heater 110 for generating stock solution 52.

The amount of stock solution 52 introduced into the water stream to provide a detergent use solution is controlled by the requirements of the facility that utilizes the device 10. In the case of a commercial vehicle washing facility, the facility will instruct the device 10 of the requirements when stock solution 52 is required, and the pump 120 will respond by injecting desired amounts of the stock solution into a water stream to create a detergent use solution. If the stock solution 52 is aspirated into a water supply, it is believed that the rate of aspiration will be controlled by a valve placed between the stock solution reservoir 14 and the pressurized water line.

The air flow for powering the stock solution pump 120 is regulated by the air regulator 132 and the air valve solenoid 134 when a signal is provided from the washing facility that additional detergent is needed, the air valve solenoid 134 responds by opening the air inlet 126 to the stock solution pump 120 causing the stock solution pump 120 to inject stock solution 52 into the water line to create detergent use solution. The drain air filter 136 is preferably provided to remove moisture from the airline to prevent damage to the stock solution pump 120.

The hot water heater 110 preferably controls the temperature of the water to provide a relatively constant water temperature that is sprayed from the nozzle 62. Preferably, the water temperature is provided within a range of about 40° F. to about 150° F., and more preferably between about 80° F. and about 140° F. It should be understood that the target temperature can be controlled and depends upon the desired concentration in the stock solution and on the chemistry of the solid detergent. A temperature sensor can be provided for sensing the temperature of the water sprayed from the nozzle 62. This sensed temperature can be used to adjust the hot water heater 110 to provide a desired water temperature.

The temperature of the water sprayed against the exposed surface 40 is preferably controlled to a relatively constant temperature. In general, the phrase "relatively constant temperature" refers to a temperature fluctuation range that is controlled to provide a relatively consistent concentration of stock solution 52. Preferably, the temperature of the water is controlled to within about 30° F., and more preferably to within about 10° F. In a preferred steady state operation, the water temperature is controlled to within about 5° F. It should be understood that the term "steady state" refers to the temperature conditions after initial heating of cooled equipment such as piping.

The water sprayed from the nozzle 62 is preferably provided at a relatively low pressure and wets the exposed surface 40 of the lowest block 35. Preferably, the pressure of the water from the nozzle 62 is between about 10 psig and about 40 psig.

The support member 15 is provided so that it allows water and stock solution to flow therethrough. If desired, the openings in the support member can be sufficiently small to control the flow of undissolved particulates therethrough. Preferably, the support member 15 is provided in the form of a screen having a mesh size of between about 1/16 sq. in. and about 4 sq. in., and more preferably between about 1 sq. in. and about 2 sq. in. It should be understood that the support member 15 can be used to help block flow of water to the solid block 34 and to help prevent flow of undissolved particulates from the solid block 34 to the container 50.

The device 10 can be provided having a housing 150 that encloses the internal components 104. Access to the internal components 104 can be provided through the door 102 that can be locked in place or unlocked using the lock 152. The device 10 can be provided as a freestanding device or can be attached to another structure. As shown, the device 10 includes legs 154 for supporting the device. An on/off switch 156 can be provided for powering the device 10. Preferably, a spring 160 is provided for biasing the lid or cover 44 in a closed position as shown in FIG. 2.

Figure 4:
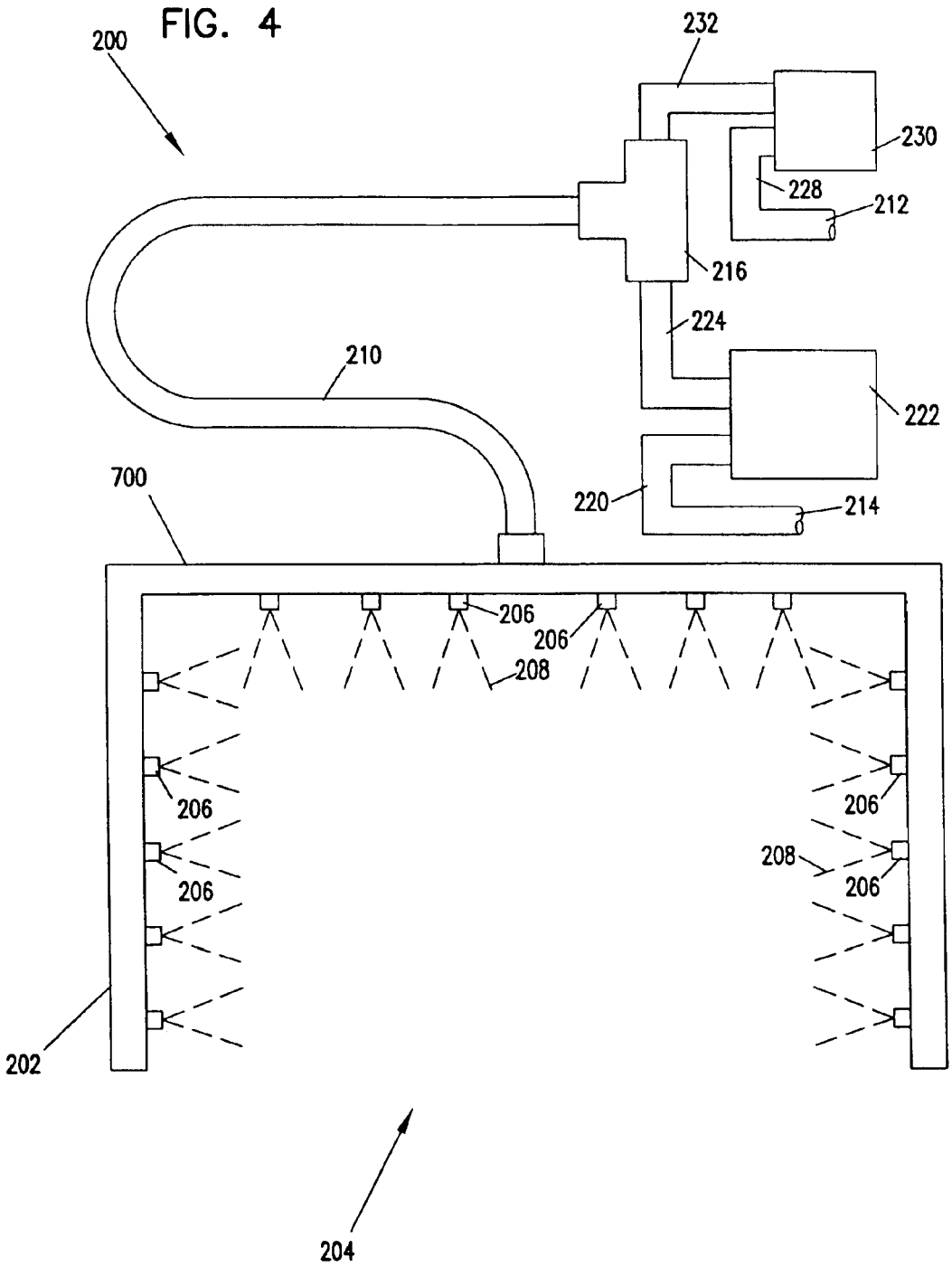
FIG. 4 is a schematic diagram of an apparatus for applying a detergent use solution to a vehicle according to the principles of the invention.

The detergent use solution generated according to the invention can be used in commercial vehicle washing facilities to wash motor vehicles such as automobiles, trucks, sports utility vehicles, and boats. An exemplary cleaning arm apparatus used in commercial vehicle washing facilities is shown at reference numeral 200 in FIG. 4. The cleaning arm apparatus 200 includes a spray arch 202 that is provided so that it extends around a vehicle provided within the interior area 204. A wash cycle generally involves delivery of the detergent use solution 208 to the vehicle from the front of the vehicle to the rear of the vehicle or vice versa. The spray arch 202 includes a plurality of spray nozzles 206 that direct detergent use solution 208 onto the exterior of the vehicle during a wash cycle. The detergent use solution 208 is provided to the spray arch 202 via the delivery line 210 and is provided under pressure. The detergent use solution 208 is prepared by mixing a liquid detergent concentrate 212 and water 214 in a mixing valve 216. The water 214 flows through the water source line 220, into the pump 222, and is forced out of the pump 222 under pressure into the water line 224 and into the mixing valve 216. The liquid detergent concentrate 212 flows through the liquid detergent concentrate source line 228, through the chemical pump 230, and is forced from the chemical pump 230 under pressure into the liquid detergent line 232. The liquid detergent concentrate 212 can be made available as the liquid detergent concentrate stock solution. It should be understood that the chemical pump 230 could be omitted if the liquid detergent concentrate 212 is aspirated into the high-pressure water line. In addition, it should be understood that the chemical pump 230 can be used to pump the liquid detergent concentrate 212 into a venturi so that the liquid detergent concentrate 212 then becomes mixed with the high pressure water.

The cleaning arm apparatus 200 may be employed in a conveyor type or a bay automatic type vehicle washing system. In the conveyor setup, often referred to as a tunnel wash, the spray arch 202 is stationary and the vehicle to be washed is moved through the device either by a conveyor or by driving the car therethrough along a predetermined path. In the bay automatic setup, or rollover type apparatus, the spray arch 202 is mounted on wheels for movement along a predetermined path wherein the rollover device is moved forwardly and backwardly over a stationary vehicle to wash the vehicle. In addition, both of the above-described types of vehicle washing devices may be employed in a frictionless or touchless mode wherein high pressure wash and rinse cycles are utilized so that no cleaning components touch the vehicle or in a touching mode wherein the cleaning components touch the vehicle.

The detergent concentrate 212 is preferably provided containing about 0.5 wt. % to about 25 wt. %. of active components, and more preferably about 1 wt. % to about 20 wt. %. It should be understood that the active components are those components that contribute to the cleaning, polishing, and/or drying properties of the composition. In general, water is not considered an active component.

The detergent concentrate is preferably injected into a water stream or mixed with water in mixing valve 216. The mixing valve can be referred to as a mixing bowl or tee and can include a structure sufficient to generate turbulent flow to enhance mixing. Sources of water include potable water, recycled water, and an aqueous solution. If the water is excessively high in hardness, then the water may be treated with a water softener before it is mixed with the liquid detergent concentrate.

The active ingredient level applied to the vehicle in the detergent use solution is preferably between about 0.03 wt. % and 1 wt. %. When the detergent use solution is applied to the vehicle, it is desirable that the level of active ingredient is consistent during the wash cycle across the entire vehicle.

The detergent use solution is preferably applied to vehicles in commercial vehicle washing facilities under an application pressure of between about 50 psig to about 300 psig. The chemical pump 230 and the water pump 222 may operate at any pressure to achieve the desired pressure range. In one embodiment, the water is supplied to the mixing valve 216 without using a water pump, and merely using the water pressure of the municipality supplied system. Typical water pressures supplied by a municipality are from about 15 psi to about 50 psi. Desirably, the water is supplied through a pump 222 to achieve a detergent use solution application pressure of from about 50 psi to about 300 psi. In lieu of a chemical pump, the liquid detergent concentrate may be supplied to the mixing valve 216 using an aspirator.

Figure 5:
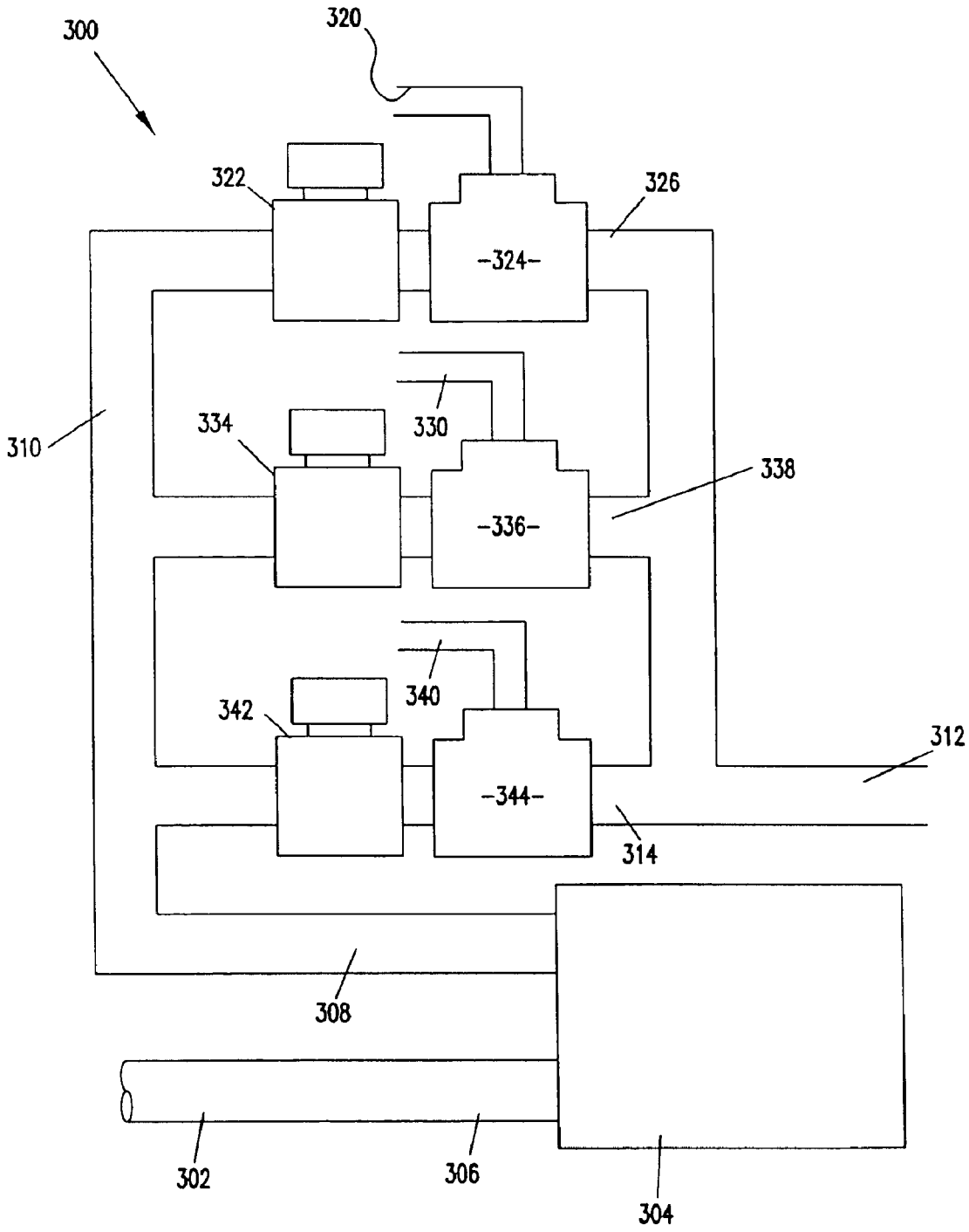
FIG. 5 is a schematic diagram of a device for generating an aqueous detergent composition from a solid detergent utilizing multiple detergents.

Now referring to FIG. 5, an alternative arrangement of the invention is indicated at reference numeral 300. In this arrangement, several devices for generating a liquid detergent concentrate from a solid detergent are arranged in parallel. Water 302 enters the water pump 304 via the line 306, and leaves the water pump 304 as high-pressure water 308 via the high-pressure line 310. The high-pressure water 308 then combines with cleaning chemicals to provide a use solution 312 that is conveyed to a spray arch via the use solution line 314.

The apparatus 300 is shown for generating multiple use solutions. That is, the apparatus 300 can be used to provide multiple cycles for washing a vehicle, or it can be used to provide different cleaning cycles. For example, it may be desirable to provide a first wash cycle using a first cleaning detergent 320. In this case, the valve 322 is opened allowing the high-pressure water 308 to combine with the first cleaning detergent 320 in the mixing valve 324. The resulting use solution 326 then flows to the spray arch. A second cleaning cycle may involve use of a second detergent concentrate 330. In this case, the valve 334 is opened allowing high pressure water 308 to mix with the second cleaning detergent 330 in the mixing valve 336 to provide a second use solution 338. Finally, it may be desirable to provide another cleaning cycle utilizing a protectant 340. In this case, the valve 342 is opened allowing the high-pressure water 308 to combine with the protectant 340 in the mixing valve 344 to provide the use solution 346.

It should be appreciated that the chemicals provided for the apparatus 300 can be used in combination or individually in a cleaning cycle. In addition, additional chemicals can be used to provide additional cycles or to combine with certain other chemicals to provide desired cleaning cycles.

Figure 6A:
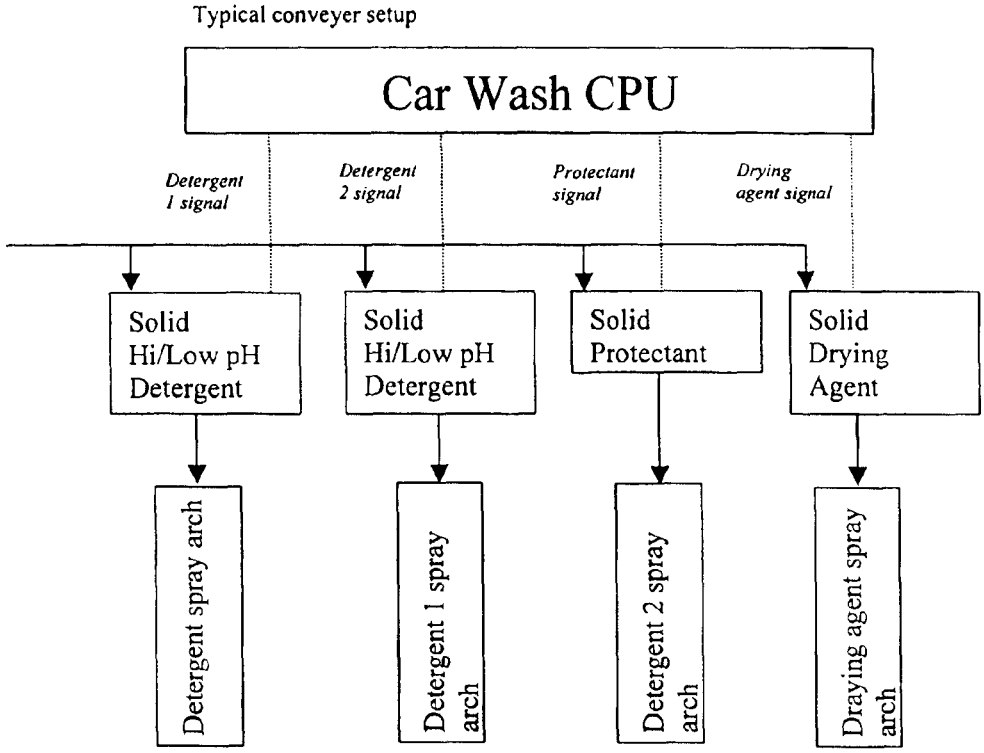
FIGS. 6(*a*) and 6(*b*) are exemplary control logic diagrams for operating the device for generating a liquid detergent concentrate from a solid detergent according to the principles of the invention.
Figure 6B:
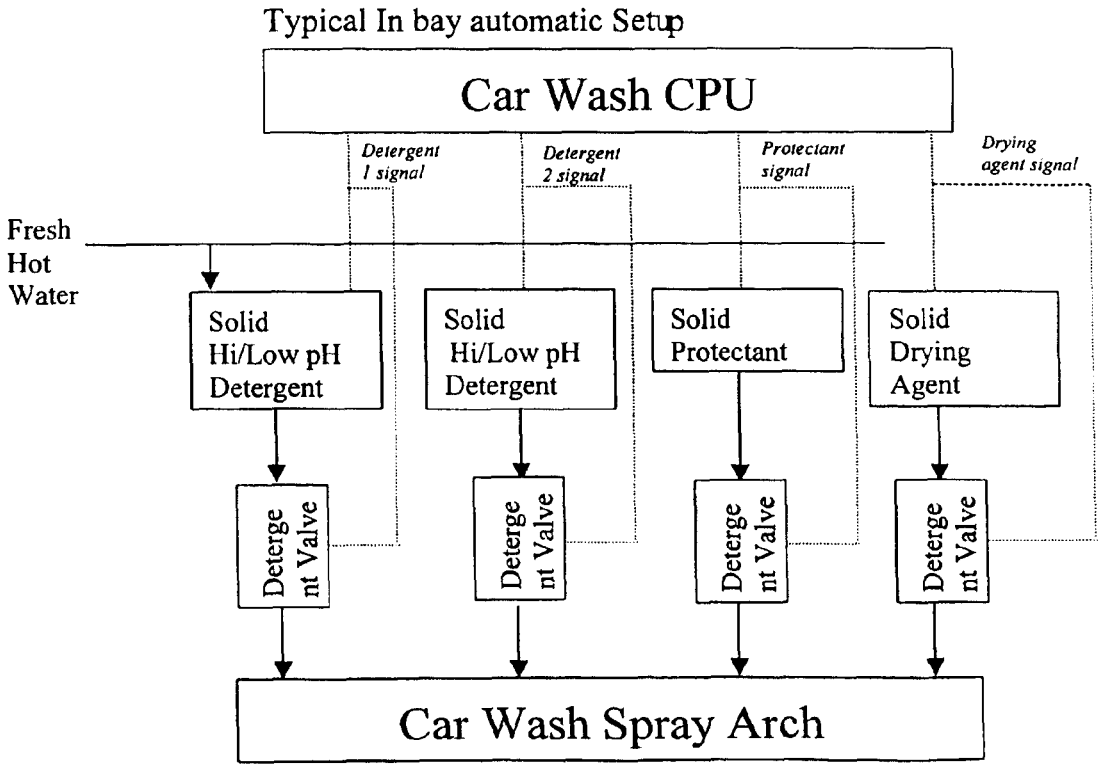

Now referring to FIGS. 6(*a*) and 6(*b*), logic diagrams are provided showing an exemplary car wash cycle for a conveyor setup (FIG. 6(*a*)) and for an in bay automatic set up (FIG. 6(*b*)).

Solid Detergent

Solid detergents that can be used according to the invention include those detergents that degrade when contacted with water to provide an aqueous detergent composition. An advantage to providing the detergent composition in a solid form is that it is possible to provide a high concentration of cleaning components. Suitable solid detergent forms include cast or compressed solid blocks, briquettes, powders, granular material, pellets, tablets, flakes, and gels.

The cleaning components of the detergent composition are generally referred to as the active ingredient components ("actives" or "active components"). The components of the detergent composition that do not significantly effect cleaning properties can be referred to as non-active components. Exemplary active components include alkaline builders, acidic builders, surfactants, corrosion inhibitors, anti-redeposition agents, chelating agents, sequestrants, dyes, and fragrances. Exemplary non-active components include water, certain solidifying agents, and certain processing aids. It should be understood that many solidifying agents and processing aids can be considered active components if they contribute to cleaning properties.

The solid detergents that can be used according to the invention include those solid detergents that contain a sufficient amount of active components so that the resulting aqueous detergent can be used to clean the surface of vehicles. A preferred application of the detergent is in the commercial vehicle washing industry. Accordingly, the types of soil desired to be removed by the detergent composition include those soils normally encountered on the surface of vehicles and normally removed by commercial vehicle washing facilities.

Solidifying Agent

Solid detergent compositions that can be used according to the invention preferably include a sufficient amount of a component responsible for solidifying the composition ("solidifying agent") to provide a solid detergent. In general, it is desirable to use an amount of solidifying agent responsible for solidifying the composition that is sufficient to provide solidification. If too little of the solidifying agent is used, the detergent is generally not sufficiently solid and may be too soft and may not degrade it a relatively constant rate. If too much of the solidifying agent is used, it is expected that the detergent composition may sacrifice active ingredient cleaning components at the expense of the solidifying component, and may result in a composition that is too hard and does not degrade sufficiently well when contacted with water.

One suitable type of solidifying agent includes polyethylene glycol and mixtures of different molecular weight polyethylene glycols. When polyethylene glycol or mixtures of different molecular weight polyethylene glycols are used as solidifying agents, they are preferably provided in an amount of at least about 5 wt. %, and are preferably used in an amount equal to or less than about 55 wt. %. More preferably, the amount of polyethylene glycol or mixture of polyethylene glycols provided in the solid detergent composition is from about 8 wt. % to about 30 wt. %. It should be understood that the discussion of weight percent in the context of the solid detergent refers to the weight percent of a component based upon the weight of the solid detergent.

Another suitable solidifying agent is urea. When urea is used as a solidifying agent, it is preferably provided in an amount from about 5 wt. % to about 32 wt. %, and more preferably in an amount of from about 8 wt. % to about 26 wt. %. The solid detergent may also include a hydrate-type of solidifying agent. In general, it is understood that a hydrate-type solidifying agent generally pulls water away from other components in the detergent composition thereby causing solidification. When a hydrate is used as a solidifying agent, it is preferably used in an amount from about 6 wt. % to about 60 wt. %, and more preferably in an amount from about 8 wt. % to about 50 wt. %. In addition, it should be understood that solidifying agents that can be used according to the invention may or may not be considered active components. That is, if the solidifying agent used is one that enhances the detersive nature of the detergent composition, it should be considered an active component.

Another preferred solidifying agent is one that forms a hydrate of a metal hydroxide or carbonate. The solidifying agent may provide for controlled dispensing by using solidification agents which having increased aqueous solubility. For systems that require less aqueous solubility or a slower rate of dissolution an organic nonionic or amide hardening agent may be appropriate. For a higher degree of aqueous solubility, an inorganic solidification agent or a more soluble organic agent such as urea can be used.

Furthermore, surfactants may be used to vary the hardness and solubility. Such surfactants include amides such as stearic monoethanolamide, lauric diethanolamide, and stearic diethanolamide. Nonionic surfactants have also been found to impart varying degrees of hardness and solubility when combined with a coupler such as propylene glycol or polyethylene glycol.

Alkaline and Acid Builders

The solid detergent composition preferably includes a sufficient amount of alkaline builder and/or acidic builder to provide desired properties. Preferably, the builders are provided in the solid detergent composition in an amount from about 1 wt. % to about 80 wt. %, and more preferably from about 3 wt. % to about 70 wt. %.

The alkalinity builder in the composition can be any alkalinity builder known that is compatible with the other components of the composition being used. Suitable alkaline sources or mixtures thereof useful in the present invention are those capable of providing the desired pH. Alkalinity sources can comprise, for example, inorganic alkalinity sources, such as an alkali metal hydroxide, an alkali metal salt, or the like, or mixtures thereof.

Suitable alkali metal hydroxides include those generally known that are compatible with the other components of the composition being used. Some examples include sodium or potassium hydroxide, and the like. An alkali metal hydroxide may be added to the composition in a variety of forms, including for example in the form of solid beads, dissolved in an aqueous solution, or a combination thereof. Alkali metal hydroxides are commercially available as a solid in the form of prilled solids or beads having a mix of particle sizes ranging from about 12–100 U.S. mesh, or as an aqueous solution, as for example, as a 50 wt % and a 73 wt % solution.

Suitable alkali metal salts include those generally known that are compatible with the other components of the composition being used. Some examples of alkali metal salts include alkali metal carbonates, silicates, phosphonates, sulfates, borates, acetates, citrates, tartrates, succinates, edates, and the like, and mixtures thereof. Some examples include potassium and sodium carbonates and bicarbonates. The carbonate salts include, for example, potassium carbonate, potassium carbonate dihydrate, potassium carbonate trihydrate, sodium carbonate, sodium carbonate decahydrate, sodium carbonate heptahydrate, sodium carbonate monohydrate, sodium sesquicarbonate, and the double salts and mixtures thereof. The bicarbonate salts include, for example, potassium bicarbonate and sodium bicarbonate and mixtures thereof. Other examples include the alkali metal ortho or complex phosphates. Examples of alkali metal orthophosphates include trisodium or tripotassium orthophosphate. The complex phosphates are especially effective because of their ability to chelate water hardness and heavy metal ions. The complex phosphates include, for example, sodium or potassium pyrophosphate, tripolyphosphate and hexametaphosphates.

Other examples of alkaline builders include ethanolamines and amines; silicates; and other like alkaline sources. Exemplary acid builders include poly(acrylic acid), butane (tricarboxylic acid), phosphonic acid, and mixtures thereof.

Surfactants

Surfactants are preferably used in the solid detergent to provide detersive properties. The solid detergent preferably includes a surfactant or a mixture of surfactants in an amount from about 1 wt. % to about 80 wt. %, and more preferably from about 5 wt. % to about 65 wt. %. Exemplary surfactants that can be used according to the invention include anionic surfactants, nonionic surfactants, amphoteric surfactants, cationic surfactants, and mixtures thereof.

Anionic surfactants are usually defined by the fact that the surface-active segment of the molecule is anionic. The anionic surfactant is usually in the form of a salt, but may also be Zwitterionic or an internal salt. Examples include, but are not limited to sulfonates such as linear alkyl benezene sulfonate and alpha olefin sulfonate, sulfates such as lauryl sulfate and lauryl ether sulfate, natural soaps, and phosphate esters. Further examples include dimmers, trimers, oligomers, polymers (copolymers, graft polymers, block polymers, etc.) having anionic surfactant groups thereon, such as amine groups, phosphate groups, or other polar charge centers with hydrophilic and/or hydrophobic contribution segments. The surfactant normally contains both a hydrophilic and a hydrophobic center or segment in the molecule to be able to be soluble or dispersible in water, yet display oleophilicity (e.g., dispersing and/or dissolving or attracting power) towards oils, grease, and other non-aqueous, oleophilic materials.

Further specific examples of suitable anionic surfactants are water-soluble salts of the higher alkyl sulfates, such as sodium lauryl sulfate or other suitable alkyl sulfates having 8 to 18 carbon atoms in the alkyl group, water-soluble salts of higher fatty acid monoglyceride monosulfates, such as the sodium salt of the monosulfated monoglyceride of hydrogenated coconut oil fatty acids, alkyl aryl sulfonates such as sodium dodecyl benzene sulfonate, higher alkyl sulfoacetates, higher fatty acid esters of 1,2-dihydroxy propane sulfonate, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosinate, and the sodium, potassium, and ethanolamine salts of N-lauroyl, N-myristoyl, or N-palmitoyl sarcosinate. Also effective are polycarboxylated ethylene oxide condensates of fatty alcohols.

Exemplary nonionic surfactants include nonylphenol ethoxylates, alcohol ethoxylates, ethylene oxide/propylene oxide block polymer surfactants, ethoxylated primary alkyl amines, alkoxylated thiol surfactants, polyoxyethylene-polyoxypropylene condensates, which are sold by BASF under the trade name "Pluronic", polyoxyethylene condensates of aliphatic alcohols/ethylene oxide condensates having from 1 to 30 moles of ethylene oxide per mole of coconut alcohol; ethoxylated long chain alcohols sold by Shell Chemical Co. under the trade name "Neodol", polyoxyethylene condensates of sorbitan fatty acids, alkanolamides, such as the monoalkoanolamides, dialkanolamides and the ethoxylated alkanolamides, for example coconut monoethanolamide, lauric isopropanolamide and lauric diethanolamide; and amine oxides for example dodecyldimethylamine oxide.

Zwitterionic or amphoteric surfactants useful with the invention include .beta.-N-alkylaminopropionic acids, n-alkyl-.beta.-iminodipropionic acids, imidazoline carboxylates, n-alky-betaines, amine oxides, sulfobetaines and sultaines.

Cationic surfactants classes include polyoxyethylene tertiary alkylamines or alkenylamines, such as ethoxylated fatty amines, quaternary ammonium surfactants and polyoxyethylene alkyletheramines. Representative specific examples of such cationic surfactants include polyoxyethylene (5) cocoamine, polyoxyethylene (15) tallowamine, distearyldimethylammonium chloride, N-dodecylpyridine chloride and polyoxypropylene (8) ethoxytrimethylammonium chloride. Many cationic quaternary ammonium surfactants of diverse structures are known in the art to be useful in the detergent solutions contemplated herein.

Corrosion Inhibitors

The solid detergent may also include corrosion inhibitors to provide corrosion resistance. Corrosion inhibitors can be provided in an amount from about 0 to about 25 wt. %, and more preferably in an amount from about 0.5 wt. % to about 20 wt. %.

Corrosion inhibitors which may be optionally added to the solid detergent include silicates, phosphate, magnesium and/or zinc ions. Preferably, the metal ions are provided in a water-soluble form. Examples of useful water-soluble forms of magnesium and zinc ions are the water-soluble salts thereof including the chlorides, nitrates and sulfates of the respective metals.

Anti-Redeposition, Chelating and Sequestering Agents

The solid detergent composition may additionally include anti-redeposition agents, chelating agents, and sequestrants wherein these components are provided in an amount from about 0 to about 80 wt. %, and more preferably from about 0.5 wt. % to about 65 wt. %.

Generally, anti-redeposition agents and sequestrants are those molecules capable of complexing or coordinating the metal ions commonly found in service water and thereby preventing the metal ions from interfering with the functioning of detersive components within the composition.

Any number of sequestrants may be used in accordance with the invention. Representative anti-redeposition agents and sequestrants include salts of amino carboxylic acids, phosphonic acid salts, water-soluble acrylic polymers, among others.

The chelating agent in the composition can be any chelating agent known that is capable of complexing with the mineral ions in the solution in the desired manner, and that is compatible with the other components of the composition. Exemplary chelating agents include amino carboxylic acid chelating agents such as N-hydroxyethyliminodiacetic acid, nitrilotriacetic acid (NTA), ethylenediaminetetraacetic acid (EDTA), N-hydroxyethylethylenediaminetriacetic acid (HEDTA), and diethylenetriaminepentaacetic acid (DTPA).

Processing Aids

The solid detergent can be prepared utilizing a processing aid. In general, a processing aid refers to a component that assists in the formation of the solid detergent. One preferred processing aid that helps in the formation of a solid detergent includes propylene glycol.

Hydrotropes are useful to maintain the organic materials, including the surfactant, readily dispersed in an aqueous cleaning solution and allow the user of the compositions to accurately provide the desired amount of the liquid detergent concentrate into the use solution. Example hydrotropes include the sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates.

Other Ingredients

Other additives known for use in vehicle cleaning compositions and solutions may be employed. Such other additives may include, but are not limited to additional surfactants, hydrotropes, additional corrosion inhibitors, antimicrobials, fungicides, fragrances, dyes, antistatic agents, UV absorbers, reducing agents, buffering compounds, corrosion inhibitors, viscosity modifying (thickening or thinning) agents, and the like.

In general, it is desirable to provide the solid detergent composition with as high an active level as possible. That is, by increasing the active level of the detergent composition, it is believed that it is possible to decrease the shipping costs associated with shipping a less concentrated detergent composition. Preferably, the active level of the solid detergent composition is at least about 50 wt. %. Preferably, the active concentration of the solid detergent composition is up to about 85 wt. %, and more preferably at least about 95 wt. %. Solid detergents containing an active concentration greater than 95 wt. % are desirable as long as the detergent can be provided in a solid form such as a block or pellet that will degrade at a desired rate when exposed to water.

Throughout this application, various publications are referenced. The disclosures of these publications in their entireties are hereby incorporated by reference into this application in order to more fully describe the state of the art to which this invention pertains.

Further, while the preferred embodiment of the invention will be described in combination with specific electronic control modules for providing control signals, it will be understood that other control circuits, including mechanical, hydraulic, digital, analog, radio frequency, and optical systems, could equally well be configured within the spirit and scope of this invention. It is also to be understood that the terminology used herein is for the purpose of describing particular embodiments only and is not intended to be limiting.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method for washing a vehicle, the method comprising steps of:

(a) applying water against a solid detergent provided within a solid detergent reservoir to generate a liquid detergent concentrate, wherein the solid detergent is provided in the form of a block, and the water applied against the solid detergent is provided at a relatively constant temperature within a range of about 40° C. and about 150° C. as a result of heating in a water heater;

(b) collecting the liquid detergent concentrate in a liquid detergent concentrate reservoir, wherein the solid detergent reservoir, the water heater, and the liquid detergent concentrate reservoir are components of a device for generating a liquid detergent concentrate from a solid detergent;

(c) withdrawing liquid detergent concentrate from the liquid detergent concentrate reservoir and combining the liquid detergent concentrate with water to provide a use solution; and (d) washing the vehicle with the use solution.

2. A method according to claim 1, further comprising:

(a) monitoring the amount of liquid detergent concentrate within the liquid detergent concentrate reservoir and providing a first signal and a second signal, the first signal indicating when sufficient liquid detergent concentrate is provided within the liquid detergent concentrate reservoir and the second signal indicating when more liquid detergent concentrate is needed within the liquid detergent concentrate reservoir.

3. A method according to claim 2 further comprising:

(a) controlling the flow of water against the solid detergent provided within the solid detergent reservoir based on the first signal and the second signal.

4. A method according to claim 1, wherein the relatively constant temperature comprises a temperature that is allowed to fluctuate within a range of about 10° F.

5. A method according to claim 1, wherein the water is controlled at a temperature of about 80° F. to about 140° F.

6. A method according to claim 1, further comprising a step of:

(a) heating the water in a hot water heater prior to the step of applying water against a solid detergent.

7. A method according to claim 1, wherein the solid detergent comprises surfactant in an amount of about 1.0 wt. % to about 80 wt. %.

8. A method according to claim 1, wherein the solid detergent comprises surfactant in an amount of about 5 wt. % to about 65 wt. %.

9. A method according to claim 1, wherein the method further comprises a step of:

(a) removing the liquid detergent concentrate from the liquid detergent concentrate reservoir and diluting the liquid detergent concentrate with a water to form a use solution.

10. A method according to claim 1, wherein the method further comprises a step of:

(a) directing the use solution to a vehicle wash system.

* * * * *